US010737850B2

(12) United States Patent
Aznar et al.

(10) Patent No.: US 10,737,850 B2
(45) Date of Patent: Aug. 11, 2020

(54) CONTAINER FOR FOOD USE

(71) Applicant: MAPED, Argonay (FR)

(72) Inventors: Francois Aznar, Talloires (FR); Bruno Gstalder, Nonglard (FR)

(73) Assignee: MAPED, Argonay (FR)

( * ) Notice: Subject to any disclaimer, the term of this patent is extended or adjusted under 35 U.S.C. 154(b) by 0 days.

(21) Appl. No.: 16/086,518

(22) PCT Filed: Feb. 24, 2017

(86) PCT No.: PCT/EP2017/054375
§ 371 (c)(1),
(2) Date: Sep. 19, 2018

(87) PCT Pub. No.: WO2017/167510
PCT Pub. Date: Oct. 5, 2017

(65) Prior Publication Data

US 2019/0127127 A1 May 2, 2019

(30) Foreign Application Priority Data

Mar. 31, 2016 (FR) ..... 16 52834

(51) Int. Cl.
*B65D 41/06* (2006.01)
*B65D 45/24* (2006.01)
(Continued)

(52) U.S. Cl.
CPC ..... *B65D 45/24* (2013.01); *A45C 11/20* (2013.01); *A45C 13/02* (2013.01); *B65D 25/04* (2013.01);
(Continued)

(58) Field of Classification Search
CPC .... B65D 45/24; B65D 25/04; B65D 43/0222; B65D 53/02; B65D 81/3216; B65D 41/06;
(Continued)

(56) References Cited

U.S. PATENT DOCUMENTS 3,860,136 A * 1/1975 Romney ..... B65D 41/06 215/222
3,880,313 A * 4/1975 Akers ..... B65D 41/065 215/211
(Continued)

OTHER PUBLICATIONS

International Search Report dated Jun. 22, 2017, in PCT/EP2017/054375, filed Feb. 24, 2017.

*Primary Examiner* — Elizabeth J Volz
(74) *Attorney, Agent, or Firm* — Oblon, McClelland, Maier & Neustadt, L.L.P.

(57) ABSTRACT

A container for food use is provided, including a container body; a cover configured to be coupled to the container body to close the container; and a locking member including at least two tabs, the locking member being mounted pivoting on the cover about an axis of rotation between an unlocked position and a locked position, the container body including at least two retaining wings extending in a plane perpendicular to the axis of rotation, side faces of the at least two retaining wings falling within at least one circle of which a center passes through the axis of rotation, and each tab of the locking member including a side face complementary to a side face of a retaining wing, and a curved end configured to engage with a respective retaining wing of the container body to axially hold the cover coupled to the container body in the locked position.

11 Claims, 8 Drawing Sheets

(51) Int. Cl.

| | |
|---|---|
| ***A45C 11/20*** | (2006.01) |
| ***A45C 13/02*** | (2006.01) |
| ***B65D 25/04*** | (2006.01) |
| ***B65D 43/02*** | (2006.01) |
| ***B65D 53/02*** | (2006.01) |
| ***B65D 81/32*** | (2006.01) |

(52) U.S. Cl.
CPC ..... *B65D 43/0222* (2013.01); *B65D 53/02* (2013.01); *B65D 81/3216* (2013.01); *A45C 2013/026* (2013.01)

(58) Field of Classification Search
CPC ..... B65D 41/36; A45C 11/20; A45C 13/02; A45C 2013/026
USPC ..... 220/23.86, 293, 296; 215/222
See application file for complete search history.

(56) References Cited

U.S. PATENT DOCUMENTS 4,053,078 A * 10/1977 Herr ..... B65D 41/06 215/222
5,638,976 A * 6/1997 Arnold ..... B65D 43/0231 215/330
5,927,528 A 7/1999 Jones
7,819,264 B2 * 10/2010 Brozell ..... B65D 50/043 215/222

* cited by examiner

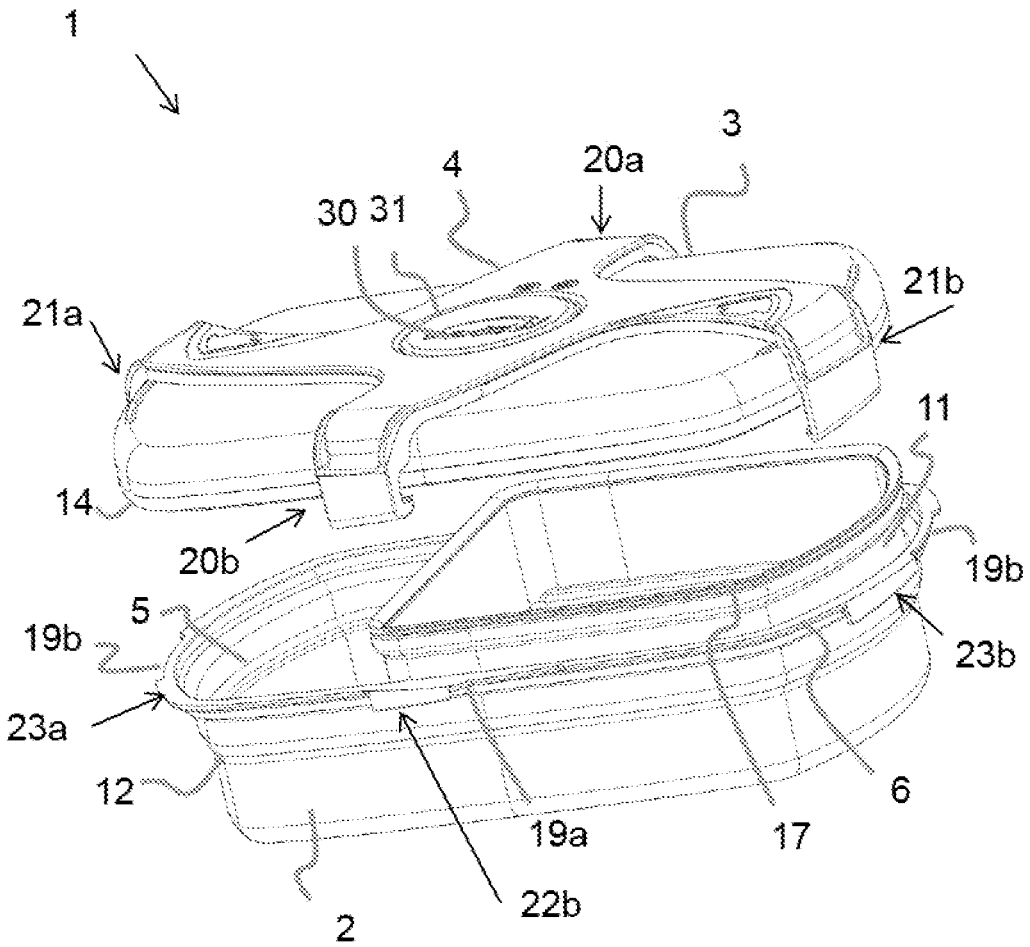
FIG.1
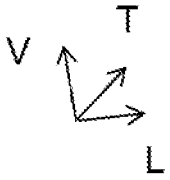

FIG.2
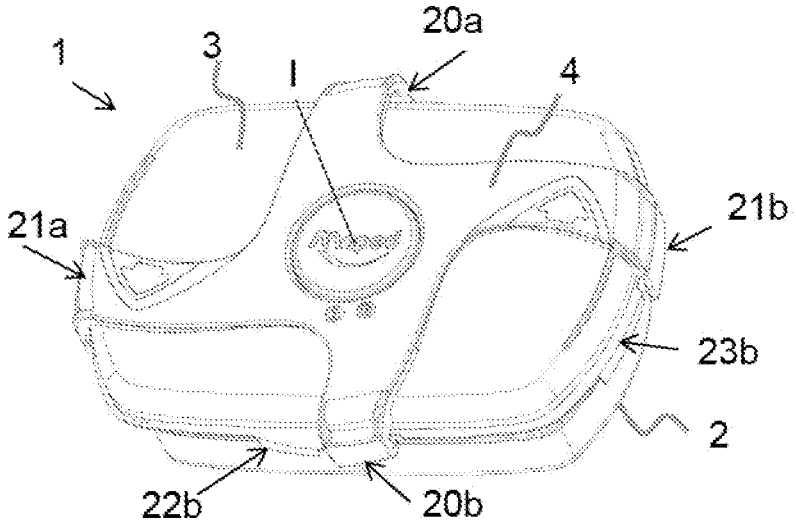
FIG.3
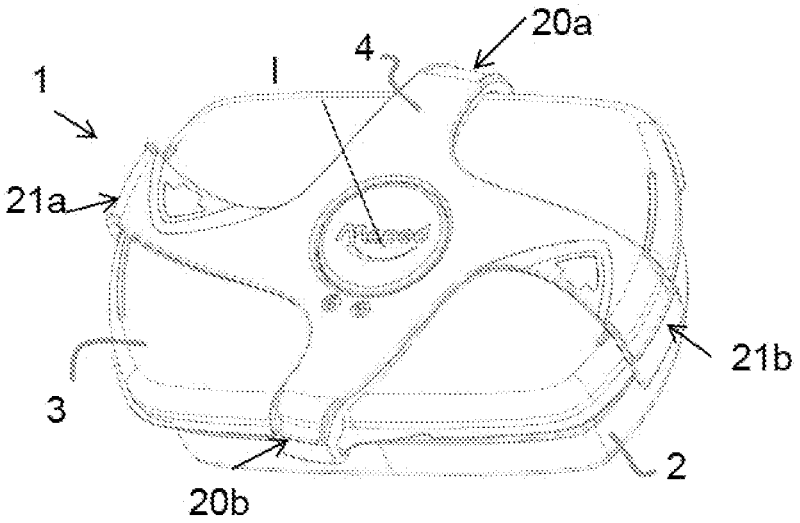
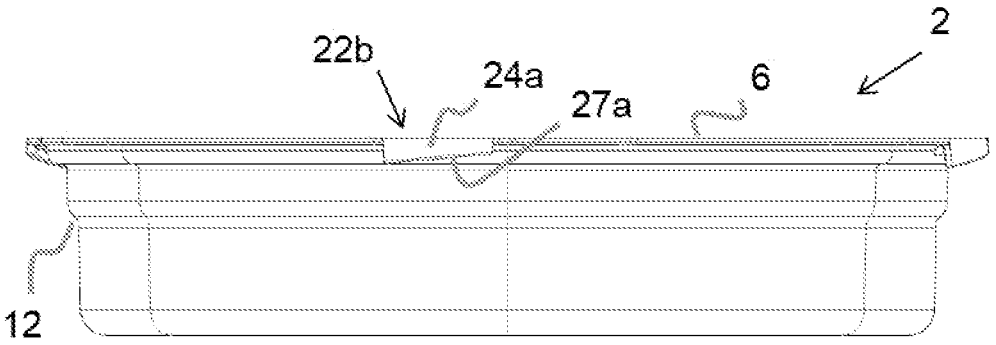
FIG.4

FIG.5
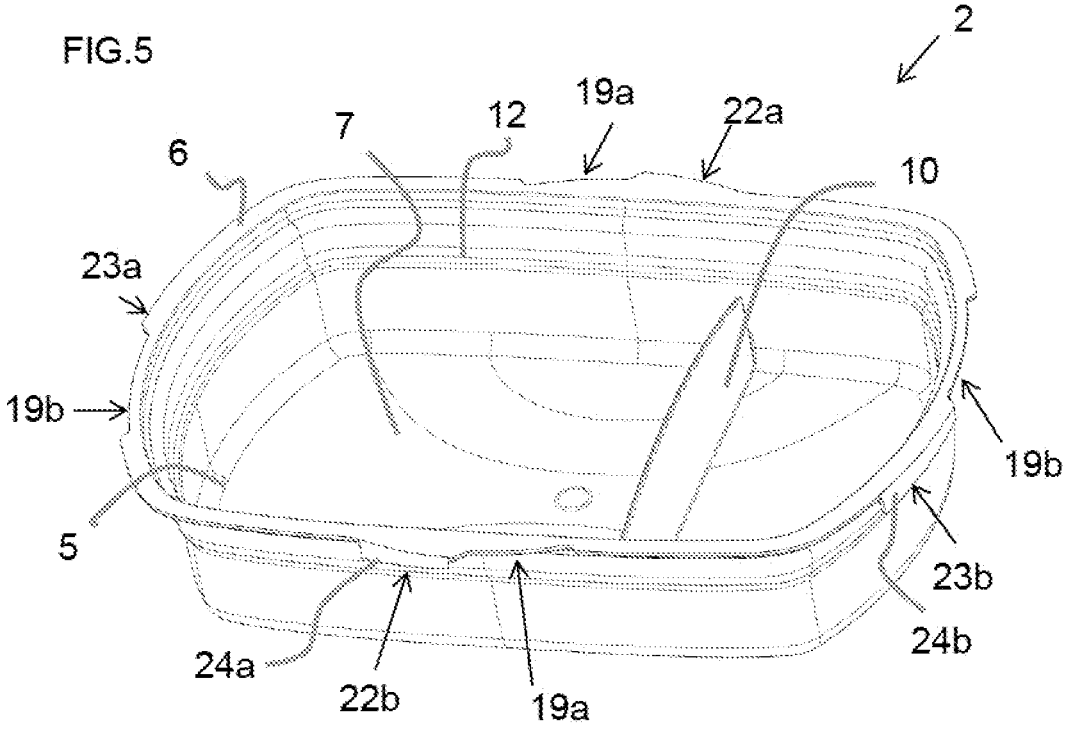
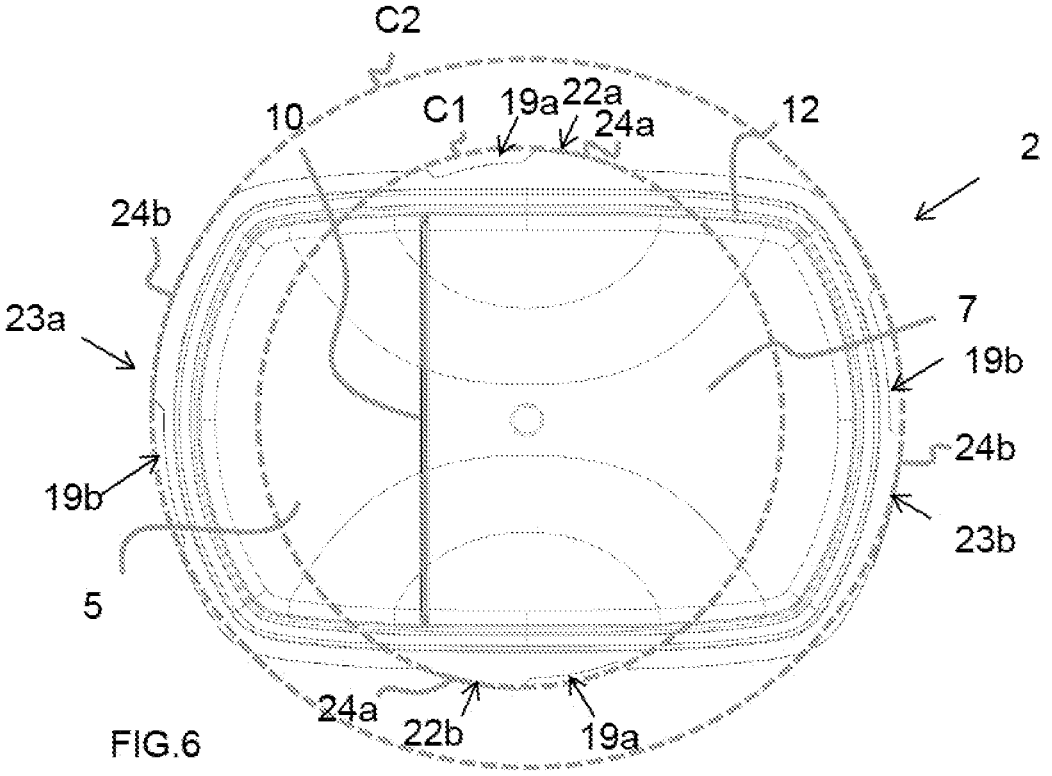
FIG.6

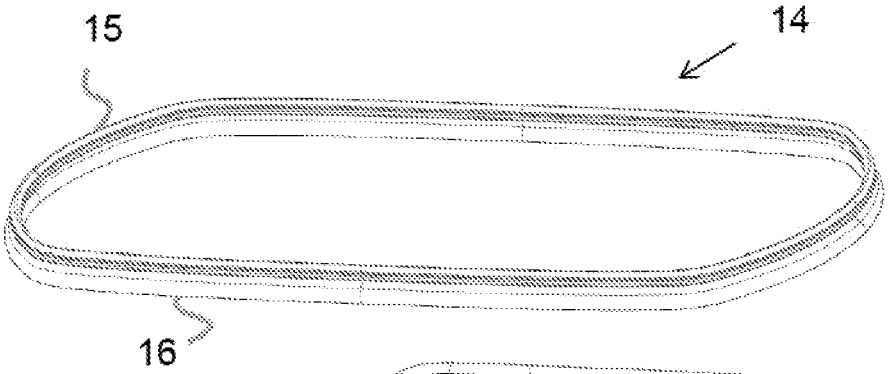
FIG.10a
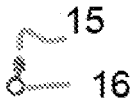
FIG.10b
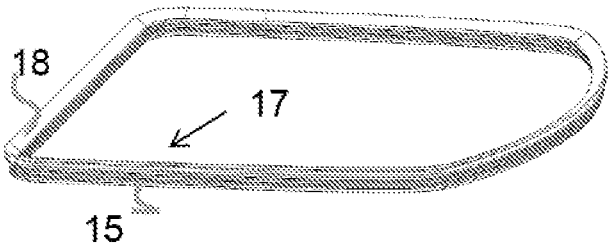
FIG.11a
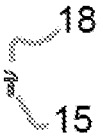
FIG.11b
Fig.12
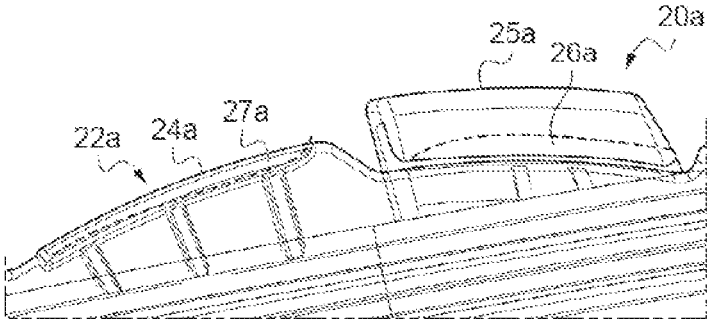

CONTAINER FOR FOOD USE

The present invention relates to a container for food use allowing food to be transported and preserved.

Containers that are intended for transporting and preserving food, particularly for meals to be taken at school or at work, generally comprise a container body receiving the food and a detachable cover that can be coupled to the container body.

The containers are normally closed by clipping the cover onto the upper edge of the container body. This type of closure, which is particularly achievable on containers made of plastic material, is carried out by pressing the cover, optionally followed by localized pressing on the clip.

Clipping needs to be firm in order to obtain a good seal. However, the stronger the closure the harder it is to open or close the container, particularly for young children. Furthermore, full and durable closure is not guaranteed. The container can open and the food contained in the container can leak out when transported or when the container is tilted or overturned.

Moreover, wear problems can arise over time after numerous opening and closing operations, which can lead to suboptimal performance with respect to the seal.

Other systems for closing containers provide locking means comprising two or four hooks. The hooks, which are generally freely mounted on the cover, allow firm and sealed closure of the container.

However, several actions are required for locking/unlocking the hooks. Indeed, the hooks must be operated one after the other, each individually. Furthermore, significant activation forces, such as forces of approximately 1 to 2 kilos, must be exerted in order to activate them. For children, the number of operations to be carried out associated with these high forces can result in incorrect closure of the container, which can remain unlocked or incorrectly locked. There is also a risk of the hooks breaking following incorrect operation, rendering the container unusable.

One of the aims of the present invention is to propose a container for food use, the closure of which is provided in a durable manner, in order to prevent the container from opening during transportation, and the activation of which can be easily carried out, particularly by young children.

To this end, the aim of the invention is a container for food use comprising:

- a container body;
- a cover that can be coupled to the container body to close the container, characterized in that the container comprises:
  - a locking member comprising at least two tabs, the locking member being mounted pivoting on the cover about an axis of rotation between an unlocked position and a locked position;
  - the container body having at least two retaining wings extending in a plane perpendicular to the axis of rotation, the side faces of the retaining wings falling within at least one circle of which the center passes through the axis of rotation;
  - each tab of the locking member having:
    - a side face complementary to a side face of a retaining wing; and
    - a curved end configured to engage with a respective retaining wing of the container body to axially hold the cover coupled to the container body in the locked position.

The closure of the container thus can be locked through simple pivoting of the locking member on the container body about the axis of rotation, as a result of the arc of a circle shape of the side faces of the retaining wings and of the complementary arc of a circle shape of the side faces of the tabs of the locking member. This locking can be obtained independently of the general shape of the container. It is thus possible to design a container with flat side walls, such as a container with a general parallelepiped or prismatic shape, with rotary locking about a vertical axis of rotation.

This rotary locking allows durable and easy closure of the container, at a plurality of points, through a single operation. The force to be exerted to lock the container also can be relatively low. Therefore, the container can be easily operated by children. Furthermore, such a container is simple to produce and therefore is economical.

According to one or more features of the container for food use, taken individually or in combination:

- the curved end of each tab of the locking member bears an axial ramp configured to engage with a complementary axial ramp borne by a respective retaining wing, in order to progressively increase the clamping of the cover on the container body with the rotation of the locking member to the locked position;
- at least two tabs of the locking member are arranged opposite each other relative to the axis of rotation;
- the locking member comprises four tabs each having a curved end configured to engage with a respective retaining wing of the container body;
- at least one first curved end of a first tab is configured to engage with a first retaining wing and at least one second curved end of a second tab is configured to engage with a second retaining wing, the first side face of the first retaining wing falling within a first circle, the second side face of the second retaining wing falling within a second circle, the second circle having a larger diameter than that of the first circle;
- the container body has a bottom of general polygonal shape;
- a through-hole is arranged in the cover, the through-hole being clear when the locking member is in the unlocked position and being obstructed by a protuberance of the locking member in the locked position;
- the locking member is produced as a single part;
- the cover comprises guiding and retaining elements engaging with the locking member to guide the pivoting of the locking member and to retain the locking member on the cover;
- the container for food use comprises a first gasket seal partly received in a peripheral groove of an edge of the container body or of the cover, the first gasket seal being at least partly compressed between the cover and the container body when the locking member is in the locked position;
- the first gasket seal comprises a toothed peripheral portion and a tubular peripheral portion surmounting the toothed peripheral portion;
- the container for food use comprises at least one second gasket seal borne by a compartment of said container received in the container body, the second gasket seal having a toothed peripheral portion and an open profile peripheral portion surmounting the toothed peripheral portion.

The invention will be better understood by means of the following description, with reference to the accompanying schematic drawings showing an embodiment of this invention by way of an example.

FIG. 1 is a general perspective view of a first example of a container for food use, in the open position with a cover positioned directly above the body of the container.

FIG. 2 is a perspective view of the container of FIG. 1, in the closed unlocked position.

FIG. 3 is a view of the container similar to FIG. 2, in the closed locked position.

FIG. 4 is a side view of the container body of FIG. 1.

FIG. 5 is a perspective view of the container body of FIG. 4.

FIG. 6 is a top view of the container body of FIG. 4.

FIG. 10*a* is a perspective view of a first gasket seal of the container of FIG. 1.

FIG. 10*b* shows a transverse section of the first gasket seal of FIG. 10*a*.

FIG. 11*a* is a perspective view of a second gasket seal of the container of FIG. 1.

FIG. 11*b* shows a transverse section of the second gasket seal of FIG. 11*a*.

FIG. 12 shows an exploded bottom view of a curved end and of a retaining wing in the unlocked position.

Figure 13:
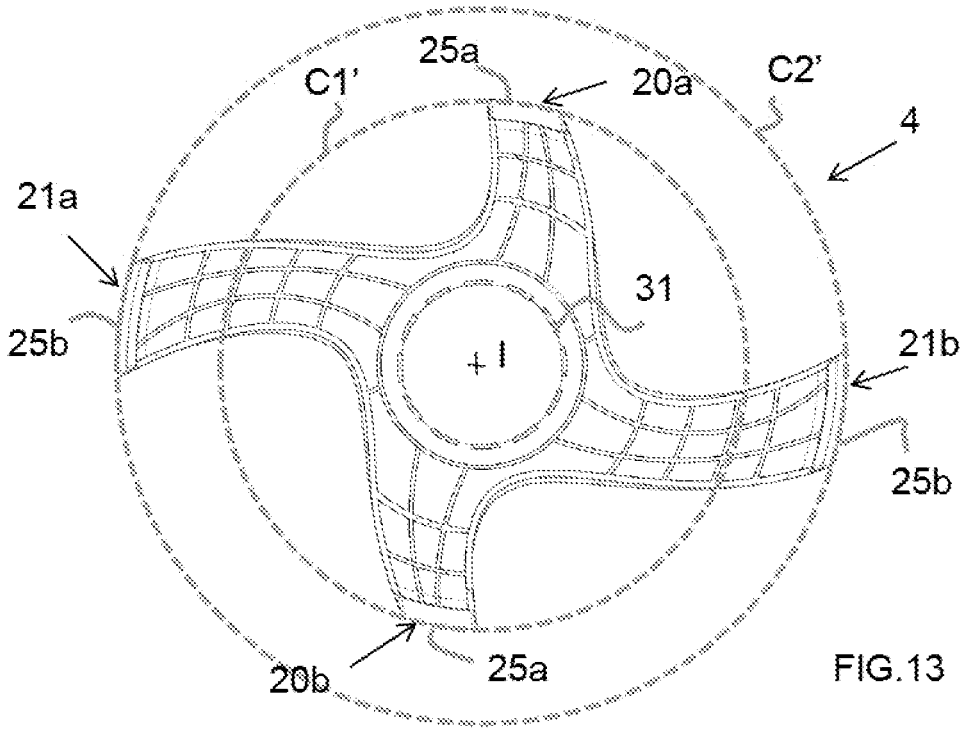

FIG. 13 shows a bottom view of the locking member of the container of FIG. 1.

Figure 14:
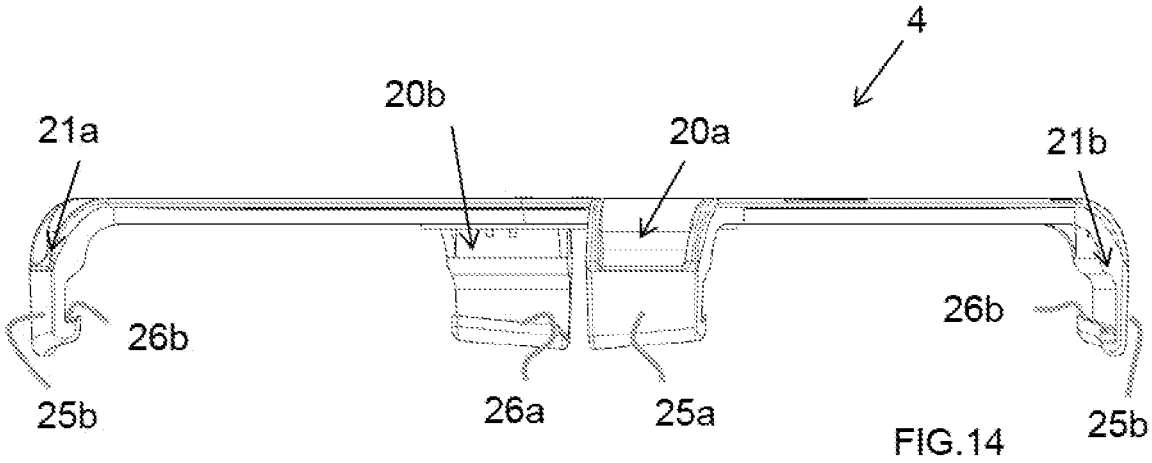

FIG. 14 shows a side view of the locking member of FIG. 13.

Figure 15:
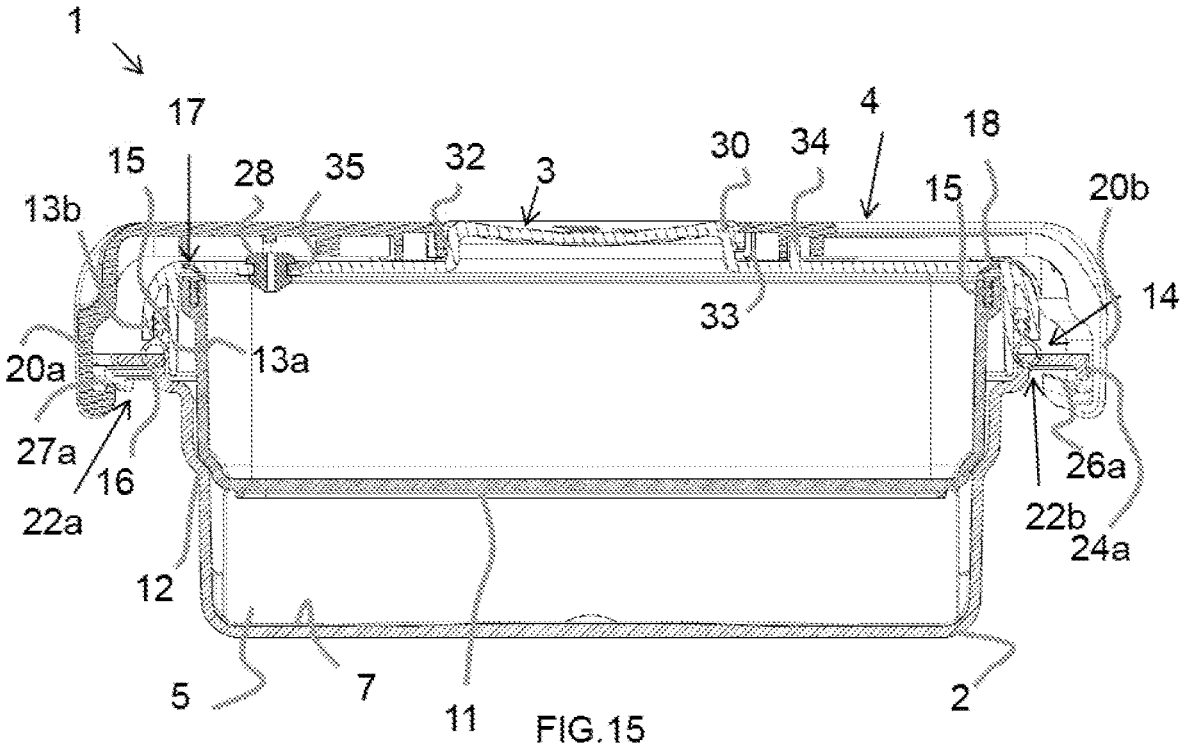

FIG. 15 is a vertical section view of the container for food use of FIG. 1, in the closed unlocked position.

Figure 16:
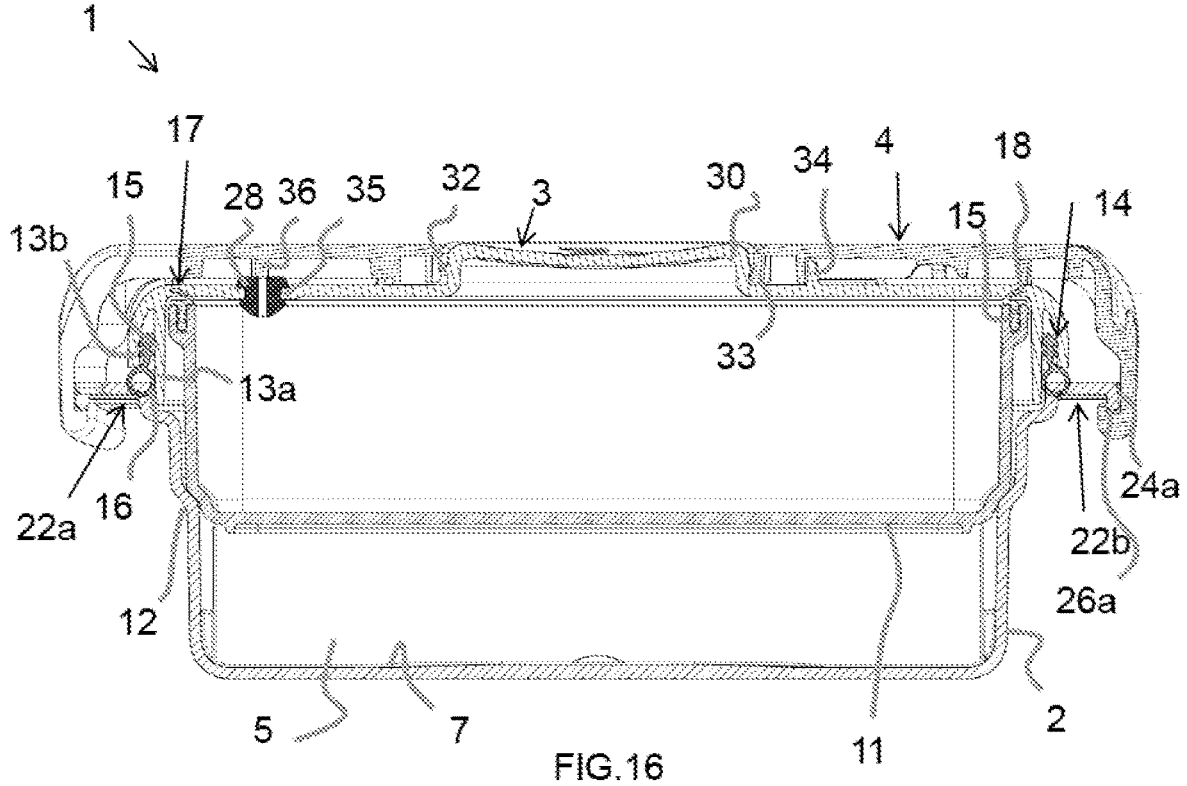

FIG. 16 is a view similar to FIG. 15, in the closed locked position.

Figure 17:
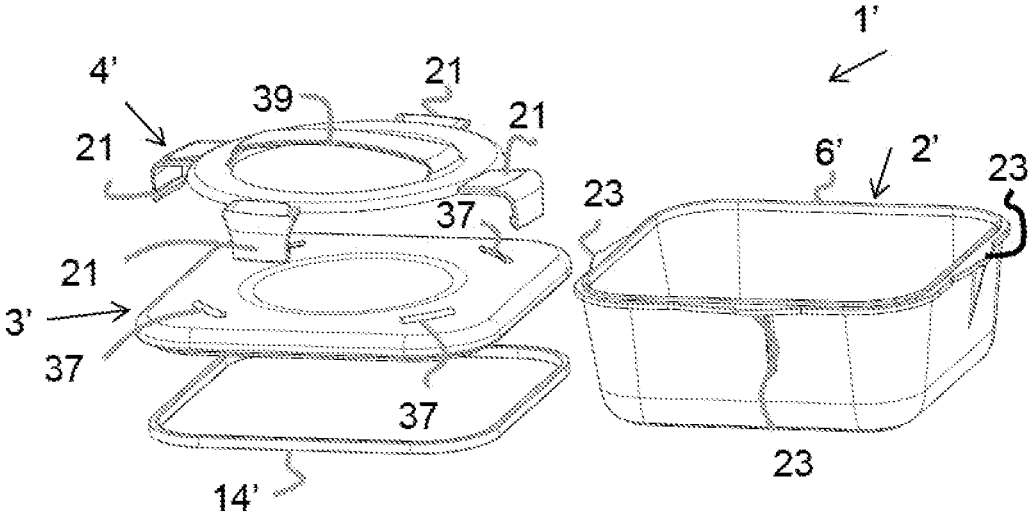

FIG. 17 is a general perspective view of a second example of a container for food use in the disassembled state.

Figure 18:
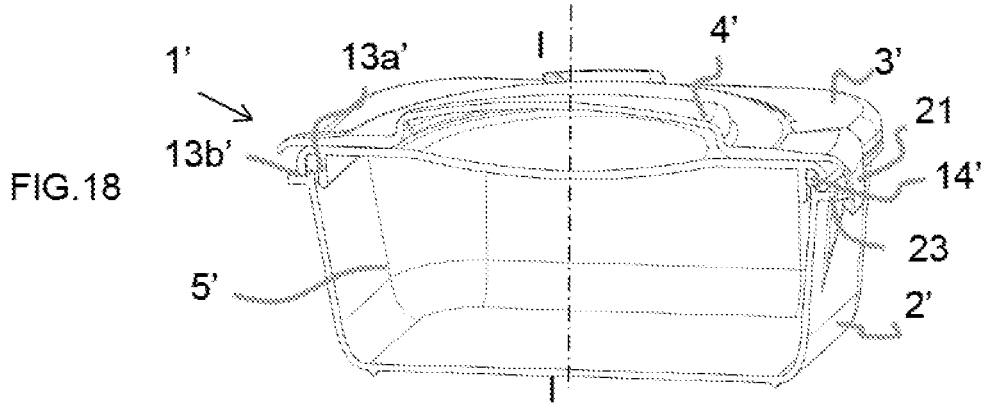

FIG. 18 is a vertical section view of the container of FIG. 17 in the assembled state, in the closed locked position.

Figure 19:
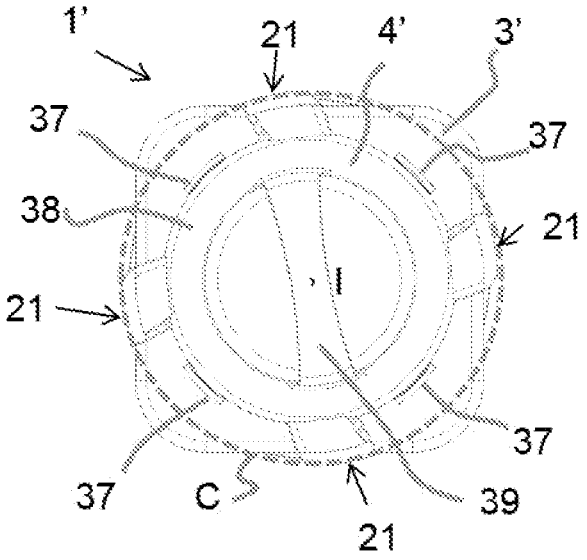

FIG. 19 is a top view of the container of FIG. 17, in the closed locked position.

Figure 20:
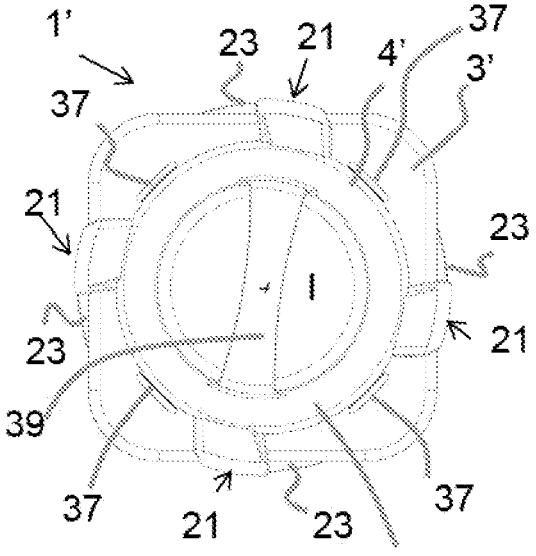

FIG. 20 is a view similar to FIG. 19 with the container in the closed unlocked position.

Throughout these figures, identical elements use the same reference numerals.

The following embodiments are examples. Even though the description refers to one or more embodiments, this does not necessarily mean that each reference relates to the same embodiment or that the features only apply to a single embodiment. Simple features of various embodiments also can be combined or interchanged in order to provide other embodiments.

Throughout the remainder of the description, longitudinal, vertical and transverse directions will be adopted in a non-limiting manner, as shown in FIG. 1 by the fixed trihedron (L, V, T) relative to the container 1.

The terms horizontal and vertical refer to the arrangement of the elements in the figures, corresponding to the container resting on a support plane.

FIG. 1 shows a container 1 for food use for transporting and preserving food, particularly for meals to be taken at school or at work.

The container 1 comprises three distinct elements, namely a container body 2, a cover 3 that can be coupled to the container body 2 to close the container 1, and a locking member 4 surmounting the cover 3.

The locking member 4 is mounted pivoting on the cover 3 about an axis of rotation I-I between an unlocked position (FIG. 2) and a locked position (FIG. 3), in which the locking member 4 locks the cover 3 coupled to the container body 2.

As can be seen more specifically in FIGS. 4, 5 and 6, the container body 2 is a container (or receptacle). It has a housing 5 particularly adapted to receive foodstuffs.

Figure 7:
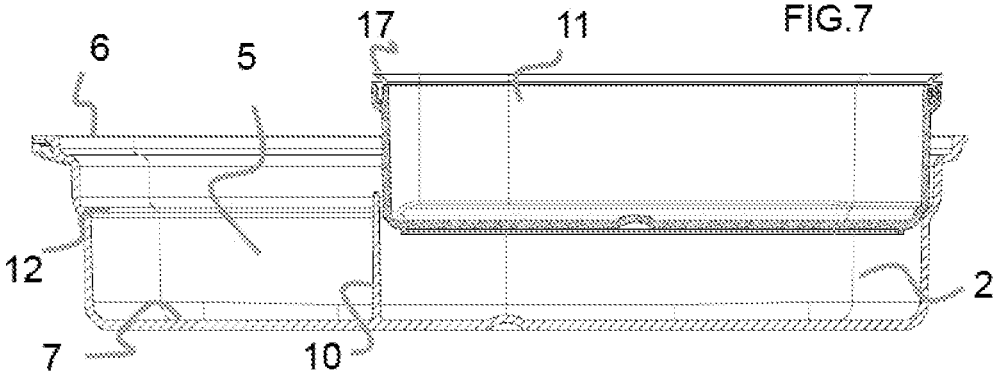
FIG. 7 shows a section view of the container body and of a compartment received in the container body.

The container body 2 can comprise one or more partitions 10 that are vertically arranged in the container body 2 to compartmentalize the bottom 7. The container 1 also can comprise at least one detachable compartment 11, the dimensions of which are adapted to be at least partly inserted into a sub-housing of the container body 2 (FIG. 7).

Furthermore, the container body 2 can have a raised element 12 that is adapted to raise the compartment 11 in the housing 5 of the container body 2. The raised element 12 allows a space to be provided under the compartment 11 and thus allows the container body 2 to be compartmentalized by height. The raised element 12 is formed, for example, by a narrowing of the housing 5 of the container body 2 that is at least partially peripheral, for example.

Figure 8:
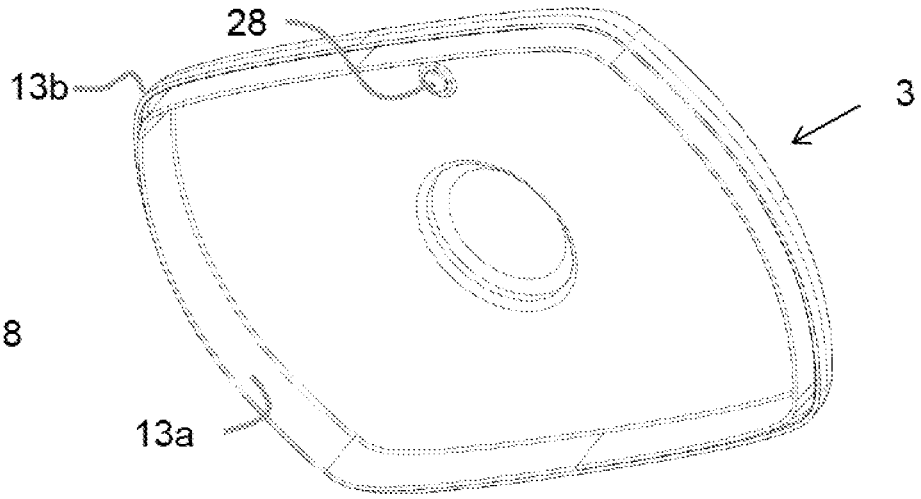
FIG. 8 is a perspective view of the cover of FIG. 1.

As can be seen in FIG. 8, the edge of the cover 3 has, for example, a double wall 13*a*, 13*b*. The walls 13*a*, 13*b* extend vertically, i.e. parallel to the side walls of the container body 2 by forming a peripheral groove between the two walls 13*a*, 13*b*. When the cover 3 is coupled to the container body 2, the end of the internal wall 13*a* is received in the housing 5 of the container body 2, for example, against a peripheral tightening of the container body 2.

The container 1 for food use can comprise a first gasket seal 14 partly received in a peripheral groove of the container body 2 or of the cover 3 (FIGS. 1, 10*a* and 10*b*). The first gasket seal 14 is at least partly compressed between the cover 3 and the container body 2 when the locking member 4 is in the locked position, which allows the container 1 to be provided with a good seal.

According to an embodiment that is better shown in FIGS. 10*a*, 10*b*, 15 and 16, the first gasket seal 14 comprises a toothed peripheral portion 15 and a tubular peripheral portion 16 surmounting the toothed peripheral portion 15.

The transverse section of the toothed peripheral portion 15 is in the shape of a fir tree or a harpoon, with two or three levels of retaining teeth, allowing the first gasket seal 14 to be inserted and retained in a cavity, such as in the peripheral groove of the double wall 13*a*, 13*b* of the cover 3.

The tubular peripheral portion 16 forms the seal, strictly speaking. The transverse section of the tubular peripheral portion 16 has a substantially oval or round shape in the uncompressed state. A round transverse section allows a first symmetrical gasket seal 14 to be obtained that can be equally positioned in the cavity in one direction or the other, without any possible error in orientation.

The container 1 also can comprise at least one second gasket seal 17 borne by the edge of the compartment 11 received in the container body 2 (FIGS. 7, 11*a*, 11*b*, 15 and 16).

According to one embodiment, the second gasket seal 17 comprises a toothed peripheral portion 15 and an open profile peripheral portion 18 surmounting the toothed peripheral portion 15.

The transverse section of the open profile peripheral portion 18 has a "C" shape in the rest state. This peripheral portion 18 has, for example, two facing lips. It can be mounted in both directions, the orientation of the opening equally can be directed toward the outside or the inside of the container 1. This open shape requires less compression force from the user than is required to compress the closed shape of the tubular peripheral portion 16, nevertheless with a reduced guarantee of sealing.

The height of the compartment 11 can be greater than that of the portions of side walls of the container body 2 extending above the raised element 12. Thus, the edge of the compartment 11 bearing the second gasket seal 17 exceeds the edge 6 of the container body 2 when the compartment 11 is received in the container body 2. The second gasket seal 17 thus can be compressed between the compartment 11 and the upper internal wall of the cover 3 when the locking member 4 is in the locked position.

The first and the second gasket seal 14, 17 are made of silicon material, for example.

The axis of rotation I-I of the locking member 4 extends in the direction of coupling the cover 3 to the container body 2, i.e. in the vertical direction. It can be arranged in the central position, it coincides with an axis of symmetry of the container 1, for example.

The locking member 4 rotating about the axis of rotation I-I comprises at least two tabs 20*a*, 20*b*, 21*a*, 21*b*, for example, four tabs, which are preferably arranged in pairs opposite each other relative to the axis of rotation I-I (FIG. 13). The four tabs 20*a*, 20*b*, 21*a*, 21*b* are angularly spaced apart from each other by an angle of 90°, for example.

The container body 2 has at least two retaining wings 22*a*, 22*b*, 23*a*, 23*b*, the upper faces (facing the cover 3) of which extend in a plane perpendicular to the axis of rotation I-I of the locking member 4.

The container body 2 also has gaps 19*a*, 19*b* arranged next to the retaining wings 22*a*, 22*b*, 23*a*, 23*b*. The gaps 19*a*, 19*b* are designed to release the passage of the tabs 20*a*, 20*b*, 21*a*, 21*b* of the locking member 4 in the coupling direction.

The upper faces of the retaining wings 22*a*, 22*b*, 23*a*, 23*b* are coplanar and substantially extend at 90° to the side walls of the container body 2. They are formed, for example, in the edge 6 of the housing 5, on the side opposite the bottom 7 of the container body 2, by projecting in a horizontal plane (L, T).

The side faces 24*a*, 24*b* of the retaining wings 22*a*, 22*b*, 23*a*, 23*b* fall within at least one circle C1, C2 of which the center passes through the axis of rotation I-I (FIG. 6).

Each tab 20*a*, 20*b*, 21*a*, 21*b* of the locking member 4 has a side face 25*a*, 25*b* complementary to a side face 24*a*, 24*b* of a retaining wing 22*a*, 22*b*, 23*a*, 23*b*. The side face 25*a*, 25*b* of each tab 20*a*, 20*b*, 21*a*, 21*b* thus has an arc of a circle shape falling within at least one circle C1', C2', with dimensions substantially greater than the circle C1, C2 in which the side faces 24*a*, 24*b* of the retaining wings 22*a*, 22*b*, 23*a*, 23*b* fall, to allow the locking member 4 to rotate about the container body 2 (FIG. 13).

Furthermore, each tab 20*a*, 20*b*, 21*a*, 21*b* of the locking member 4 has a curved end 26*a*, 26*b* radially projecting toward the axis of rotation I-I. The curved end 26*a*, 26*b* is configured to engage with a lower edge 27*a*, 27*b* of a respective retaining wing 22*a*, 22*b*, 23*a*, 23*b* of the container body 2 in order to axially retain the cover 3 coupled to the container body 2 in the locked position.

The lower edges 27*a*, 27*b* of the retaining wings 22*a*, 22*b*, 23*a*, 23*b* are arranged on the side opposite the upper faces radially extending in the plane perpendicular to the axis of rotation I-I.

In the unlocked position, the curved ends 26*a*, 26*b* are pivoted facing the gaps 19*a*, 19*b* of the container body 2 so that the cover 3 is no longer retained on the container body 2.

The closure of the container 1 thus can be locked through simple pivoting of the locking member 4 on the container body 2 about the axis of rotation I-I, as a result of the arc of a circle shape of the side faces 24*a*, 24*b* of the retaining wings 22*a*, 22*b*, 23*a*, 23*b* and of the complementary arc of a circle shape of the side faces 25*a*, 25*b* of the tabs 20*a*, 20*b*, 21*a*, 21*b* of the locking member 4. This locking can be obtained independently of the general shape of the container 1. It is thus possible for a container 1 to be designed with flat side walls, such as a container 1 with a general parallelepiped or prismatic shape, having a bottom of general polygonal shape, such as a square, rectangular or triangular shape, with rotary locking about a vertical axis of rotation I-I.

This rotary locking allows durable and easy closure of the container 1, at a plurality of points, through a single operation. Furthermore, the force to be exerted to lock the container 1 can be relatively low. The container 1 therefore can be easily operated by children. Furthermore, such a container 1 is simple to produce and therefore is economical.

The curved end 26*a*, 26*b* of each tab 20*a*, 20*b*, 21*a*, 21*b* of the locking member 4 can bear an axial guiding surface having complementary ramps, hollows and/or protuberances configured to engage when pivoting the locking member 4 between the locked and unlocked positions with a complementary axial guiding surface borne by the lower edges 27*a*, 27*b* of the retaining wings 22*a*, 22*b*, 23*a*, 23*b*. The axial guiding surfaces provide sensory feedback for the user operating the locking member 4 in the manner of cam surfaces.

For example, and as is better shown in FIG. 14, the curved end 26*a*, 26*b* of each tab 20*a*, 20*b*, 21*a*, 21*b* of the locking member 4 bears an axial ramp configured to engage with a complementary axial ramp borne by a lower edge 27*a*, 27*b* of a respective retaining wing 22*a*, 22*b*, 23*a*, 23*b*.

The axial ramps are oriented relative to the direction of rotation of the locking member 4 between the locked and unlocked positions in order to progressively increase the clamping of the cover 3 on the container body 2 with the rotation of the locking member 4 toward the locked position. These axial ramps allow progressive compression of the gasket seals 14, 17.

The axial ramps can extend over all or part of the curved end 26*a*, 26*b* and correspondingly over all or part of the lower edges 27*a*, 27*b* of the retaining wings 22*a*, 22*b*, 23*a*, 23*b*.

For example, the curved ends 26*a*, 26*b* and the lower ends 27*a*, 27*b* bear, on the one hand, an axial ramp and, on the other hand, a flat surface falling within a radial plane perpendicular to the axis of rotation I-I, extending the axial ramp. These axial guiding surfaces provide the user with sensory feedback of less effort once a hard spot has been overcome.

Other complementary shapes, such as hollows and bulges, also can be provided to generate sensory feedback of the clipping type. These shapes are, for example, arranged in the extension of the flat surface, with their crossing by the locking member 4 being subsequent to that of the flat surface in the direction of rotation proceeding toward the locked position.

The curved ends 26*a*, 26*b* and the lower edges 27*a*, 27*b* can be tapered on the side of their mutual engagement toward the locked position (FIG. 12). This allows seamless engagement to be provided between the tabs 20*a*, 20*b*, 21*a*, 21*b* of the locking member 4 and the retaining wings 22*a*, 22*b*, 23*a*, 23*b* of the container body 2.

Furthermore, the cover 3 can have guiding and retaining elements engaging with the locking member 4 to guide the pivoting of the locking member 4 and to retain the locking member 4 on the cover 3.

Figure 9:
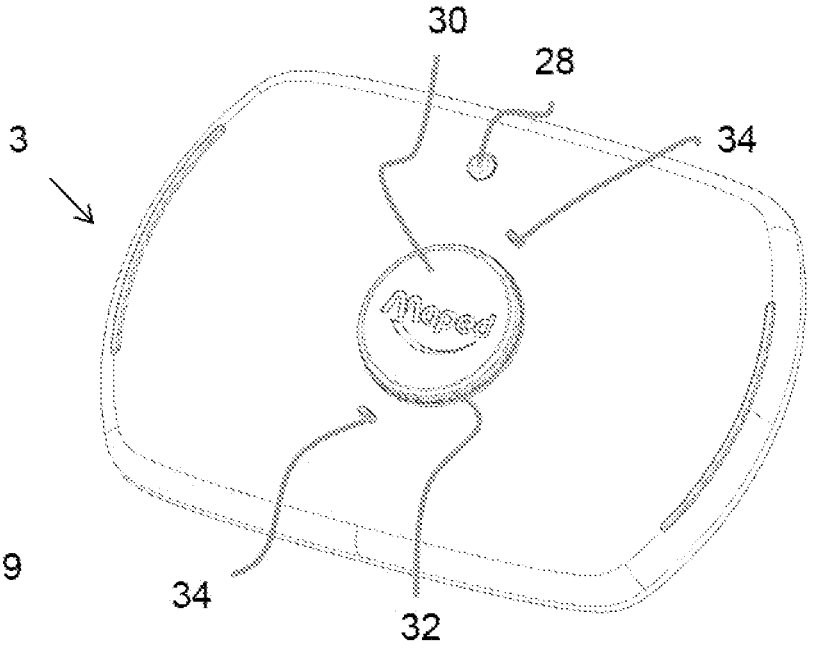
FIG. 9 is a top view of the cover of FIG. 8.

For example, the cover 3 comprises a cylindrical portion 30 arranged on the upper external wall (FIG. 9). A complementary circular hole 31 centered on the axis of rotation I-I is then provided in the body of the locking member 4 (FIG. 13). The cylindrical portion 30 thus forms a pivoting guiding element for the locking member 4.

The cover 3 and the locking member 4 can have reversible complementary retaining elements, for example, of the clipping type, i.e. engaging by elastic deformation. Thus, for example, the cylindrical portion 30 of the cover 3 comprises at least one side rib 32 engaging with a complementary side rib 33 formed in the edge of the complementary circular hole 31 for retaining the locking member 4 on the cover 3 (FIGS. 15 and 16).

The cover 3 and the locking member 4 can comprise complementary stop elements configured to limit the rotation of the locking member 4 in the locked and unlocked positions. For example, the upper external wall of the cover 3 comprises at least one spur 34, for example, two spurs, configured to engage with a complementary internal cavity of the locking member 4 (FIG. 9).

The locking member 4 can be produced as a single part. The same is the case for the container body 2, the cover 3 and the compartment 11. These elements can be made of plastic material and can be obtained by molding. The plastic material is particularly adapted to be in contact with food.

FIGS. 1 to 16 show a first embodiment, in which two first curved ends 26*a* of two first tabs 20*a*, 20*b* of the locking member 4 are configured to engage with two first retaining wings 22*a*, 22*b* and two second curved ends 26*b* of two second tabs 21*a*, 21*b* are configured to engage with two second retaining wings 23*a*, 23*b*.

The first side faces 24*a* of the first retaining wings 22*a*, 22*b* fall within a first circle C1. The second side faces 24*b* of the second retaining wings 23*a*, 23*b* fall within a second circle C2. The diameter of the second circle C2 is greater than that of the first circle C1.

Distinct radii for the first side faces 24*a*, 25*a* and for the second side faces 24*b*, 25*b* are particularly suitable for a parallelepiped container 1 with a substantially rectangular bottom 7, as shown in FIGS. 1 to 16.

Due to the various diameters of the circles C1, C2, the width of the first tabs 20*a*, 20*b* and of the first retaining wings 22*a*, 22*b* is smaller than that of the second tabs 21*a*, 21*b* and of the second retaining wings 23*a*, 23*b* further away from the center of rotation I-I. Moreover, the axial ramps borne by the first curved ends 26*a* and the first lower edges 27*a* have a greater incline than those of the second curved ends 26*b* and of the second lower edges 27*b*.

According to one embodiment better shown in FIGS. 15 and 16, a through-hole 35 is arranged in the cover 3. The container 1 can comprise a ring 28 having a through-hole, the ring 28 being received in the through-hole 35. The ring 28 can be elastic, it is made of silicon material, for example.

The through-hole of the ring 28, and therefore of the through-hole 35, is clear when the locking member 4 is in the unlocked position (FIG. 15) and is obstructed by a protuberance 36 of the locking member 4 in the locked position (FIG. 16).

The through-hole 35 thus allows the container 1 to be vented, which is particularly useful for avoiding any splattering upon opening the container 1 or any explosions/deformations of the cover 3, particularly when the container 1 has been heated. Furthermore, this allows the opening of the cover 3 to be facilitated, particularly when hot food has been introduced into the container 1 and the cooling thereof has depressurized the sealed container 1. The internal and external pressures of the container 1 thus can be balanced when the through-hole 35 is clear in the unlocked position (FIG. 15), the container 1 also being fully sealed in the locked position (FIG. 16).

During operation, starting from an open container (FIG. 1), the user closes the container 1 by moving the cover 3 toward the container body 2 in the vertical coupling direction, i.e. coaxial to the axis of rotation I-I, the curved ends 26*a*, 26*b* of the tabs 20*a*, 20*b*, 21*a*, 21*b* being inserted in the gaps 19*a*, 19*b* of the container body 2.

The container 1 is then in the closed unlocked position (FIG. 2).

The user then pivots the locking member 4 about the axis of rotation I-I. The clamping of the cover 3 on the container body 2 is progressively increased with the rotation of the locking member 4 toward the locked position, due to the engagement of the axial ramps borne by the curved ends 26*a*, 26*b* of the tabs 20*a*, 20*b*, 21*a*, 21*b* with the lower edges 27*a*, 27*b* of the retaining wings 22*a*, 22*b*, 23*a*, 23*b*. The gasket seals 14, 17 are thus progressively compressed until the locking member 4 has pivoted into the locked position (FIG. 3). The through-hole 35 is obstructed by a protuberance 36 of the locking member 4, which has pivoted into the locked position (FIG. 16).

The container 1 is then closed in a durable and sealed manner.

FIGS. 17 to 20 show another example of a container 1', in which the retaining wings 23 of the container body 2' are identical to each other and the tabs 21 of the locking member 4' are identical to each other, the side faces of the retaining wings 23 falling within a single circle C and the side faces of the tabs 21 falling within a complementary single circle C'. Such a locking member 4' is particularly suitable for a parallelepiped container 1', the container body 2 of which has a substantially square shaped bottom 7', as shown in FIGS. 17 to 20.

Furthermore, in this example, the curved end of each tab 21 of the locking member 4' can fall within a radial plane perpendicular to the axis of rotation I-I, in association with flat lower edges of the retaining wings 23 (see FIG. 17).

Also in this example, the cover 3' comprises a plurality of guiding ribs 37, four in the example, vertically projecting from the upper external wall of the cover 3'. The guiding ribs 37 have a respective shape in an arc of a circle and are oriented relative to each other so as to surround a ring 38 of the locking member 4' connecting the four tabs 21. These guiding ribs 37 allow the pivoting of the locking member 4' to be guided relative to the cover 3'.

It is also to be noted that the locking member 4' is provided with a gripping handle 39, in order to facilitate its rotational operation by the user.

The invention claimed is:

1. A container for food use, comprising:

a container body;

a cover configured to be coupled to the container body to close the container; and a locking member comprising at least two tabs, the locking member being mounted pivoting on the cover about an axis of rotation between an unlocked position and a locked position, the container body including at least two retaining wings extending in a plane perpendicular to the axis of rotation, side faces of the at least two retaining wings falling within at least one circle of which a center passes through the axis of rotation, and each tab of the locking member including:

a side face complementary to a side face of a retaining wing, and a curved end configured to engage with a respective retaining wing of the container body to axially hold the cover coupled to the container body in the locked position, wherein the cover comprises guiding and retaining elements engaging with the locking member guide the pivoting of the locking member and to retain the locking member on the cover.

2. The container according to claim 1, wherein the curved end of each tab of the locking member bears an axial ramp configured to engage with a complementary axial ramp borne by a respective retaining wing, to progressively increase clamping of the cover on the container body with the rotation of the locking member to the locked position.

3. The container according to claim 1, wherein at least two tabs of the locking member are arranged opposite each other relative to the axis of rotation.

4. The container according to claim 1, wherein the locking member comprises four tabs each including a curved end configured to engage with a respective retaining wing of the container body.

5. The container according to claim 1, wherein at least one first curved end of a first tab is configured to engage with a first retaining wing and at least one second curved end of a second tab is configured to engage with a second retaining wing, the first side face of the first retaining wing falling within a first circle, the second side face of the second retaining wing falling within a second circle, and the second circle having a larger diameter than that of the first circle.

6. The container according to claim 1, wherein the container body has a bottom of general polygonal shape.

7. The container according to claim 1, wherein the locking member is a single part.

8. The container according to claim 1, further comprising at least one second gasket seal borne by a compartment of the container received in the container body, the second gasket seal including a toothed peripheral portion and an open profile peripheral portion surmounting the toothed peripheral portion.

9. A container for food use, comprising:

a container body;

a cover configured to be coupled to the container body to close the container;

a locking member comprising at least two tabs, the locking her being mounted pivoting on the cover about an axis of rotation between an unlocked position and a locked position, the container body including at least two retaining wings extending in a plane perpendicular to the axis of rotation, side faces of the at least two retaining wings falling within at least one circle of which a center passes through the axis of rotation, and each tab of the locking member including:

a side face complementary to a side face of a retaining wing, and a curved end configured to engage with a respective retaining wing of the container body to axially hold the cover coupled to the container body in the locked position; and a through-hole arranged in the cover; the through-hole being clear when the locking member is in the unlocked position and being obstructed by a protuberance of the locking member in the locked position.

10. A container for food use, comprising:

a container body;

a cover configured to be coupled to the container body to close the container;

a locking member comprising at least two tabs, the locking member being mounted pivoting on the cover about an axis of rotation between an unlocked position and a locked position, the container body including at least two retaining wings extending in a plane perpendicular to the axis of rotation, side faces of the at least two retaining wings falling within at least one circle of which a center passes through the axis of rotation, and each tab of the locking member including:

a side face complementary to a side face of a retaining wing, and a curved end configured to engage with a respective retaining wing of the container body to axially hold the cover coupled to the container body in the locked position; and a first gasket seal partly received in a peripheral groove of an edge of the container body or of the cover, the first gasket seal being at least partly compressed between the cover and the container body when the locking member is in the locked position.

11. The container according to claim 10, wherein the first gasket seal comprises a toothed peripheral portion and a tubular peripheral portion surmounting the toothed peripheral portion.

* * * * *